US008619999B2

(12) United States Patent
Suzuki et al.

(10) Patent No.: US 8,619,999 B2
(45) **Date of Patent: *Dec. 31, 2013**

(54) AUDIO DECODING METHOD AND APPARATUS

(75) Inventors: Masanao Suzuki, Kawasaki (JP); Miyuki Shirakawa, Fukuoka (JP); Yoshiteru Tsuchinaga, Fukuoka (JP)

(73) Assignee: Fujitsu Limited, Kawasaki (JP)

( * ) Notice: Subject to any disclaimer, the term of this patent is extended or adjusted under 35 U.S.C. 154(b) by 1105 days.

This patent is subject to a terminal disclaimer.

(21) Appl. No.: 12/563,890

(22) Filed: Sep. 21, 2009

(65) Prior Publication Data

US 2010/0080397 A1 Apr. 1, 2010

(30) Foreign Application Priority Data

Sep. 26, 2008 (JP) ..... 2008-247213

(51) Int. Cl.
*H04R 5/00* (2006.01)
*G10L 19/00* (2013.01)

(52) U.S. Cl.
USPC ..... 381/22; 381/23; 704/201

(58) Field of Classification Search
USPC ..... 381/22, 23, 20, 119; 704/500–504, 201
See application file for complete search history.

(56) References Cited

U.S. PATENT DOCUMENTS

| | | | | |
|---|---|---|---|---|
| 7,082,220 | B2 | 7/2006 | Kondo et al. | |
| 8,374,882 | B2 * | 2/2013 | Shirakawa et al. | 704/500 |
| 2008/0205658 | A1 * | 8/2008 | Breebaart | 381/17 |

FOREIGN PATENT DOCUMENTS

| | | | |
|---|---|---|---|
| JP | 6-236198 | A | 8/1994 |
| JP | 10-294668 | A | 11/1998 |
| JP | 2002-223167 | A | 8/2002 |
| JP | 2002-525897 | A | 8/2002 |
| JP | 2006-67367 | A | 3/2006 |
| JP | 2007-079483 | A | 3/2007 |
| JP | 2008-519306 | A | 6/2008 |
| WO | WO-00/16315 | A2 | 3/2000 |
| WO | WO-2006/048203 | | 5/2006 |
| WO | WO-2006/048815 | A1 | 5/2006 |
| WO | WO-2006/026452 | | 9/2006 |

OTHER PUBLICATIONS

"Extended European Search Report", European application No. 09169818.3 dated Feb. 2, 2010.
Schuijers, Erik et al., "Low Complexity Parametric Stereo Coding", Audio Engineering Society Convention Paper 6073 dated May 8, 2004, pp. 1-11.
Japanese Office Action mailed Jul. 31, 2012 for corresponding Japanese Application No. 2008-247213, with English-language Translation.

* cited by examiner

*Primary Examiner* — Xu Mei
*Assistant Examiner* — Ammar Hamid
(74) *Attorney, Agent, or Firm* — Fujitsu Patent Center

(57) ABSTRACT

A decoded sound analysis unit (104) calculates, regarding the frequency-region stereo signals L(b) and R(b) decoded by the PS decoding unit (103), a second degree of similarity (109) and a second intensity difference (110) from the decoded sound signals. A spectrum correction unit (105) detects a distortion added by the parametric-stereo conversion by comparing the second degree of similarity (109) and the second intensity difference (110) calculated at the decoding side with the first degree of similarity (107) and the first intensity difference (108) calculated and transmitted from the encoding side, and corrects the spectrum of the frequency-region stereo decoded signals L(b) and R(b).

20 Claims, 21 Drawing Sheets

(a) DETECTION OF DISTORTION AMOUNT α(b)

(b) DETECTION OF DISTORTION-GENERATING CHANNEL ch(b)

(a) RELATIONSHIP BETWEEN DISTORTION AMOUNT AND CORRECTION AMOUNT (b) SPECTRUM BEFORE CORRECTION (c) SPECTRUM AFTER CORRECTION

AUDIO DECODING METHOD AND APPARATUS

CROSS-REFERENCE TO RELATED APPLICATION

Benefit of priority is hereby claimed to "Audio Decoding Method, Apparatus, and Program," Japanese Patent Application Serial No. 2008-247213, filed on Sep. 26, 2008, which application are herein incorporated by reference in its entirety.

FIELD

The present invention relates to a coding technique compressing and expanding an audio signal.

BACKGROUND

The parametric stereo coding technique is the optimal sound compressing technique for mobile devices, broadcasting and the Internet, as it significantly improves the efficiency of a codec for a low bit rate stereo signal, and has been adopted for High-Efficiency Advanced Audio Coding version 2 (Hereinafter, referred to as "HE-AAC v2") that is one of the standards adopted for MPEG-4 Audio.

FIG. 15 illustrates a model of stereo recording. FIG. 15 is a model of a case in which a sound emitted from a given sound source x(t) is recorded by means of two microphones 1501 (#1 and #2).

Here, $C_{1x}(t)$ is a direct wave arriving at the microphone 1501 (#1), and $c_2h(t)*x(t)$ is a reflected wave arriving at the microphone 1501 (#1) after being reflected on a wall of a room and the like, t being the time and h(t) being an impulse response that represents the transmission characteristics of the room. In addition, the symbol "*" represents a convolution operation, and $c_1$ and $c_2$ represent the gain. In the same manner, $c_3x(t)$ is a direct wave arriving at the microphone 1501 (#2), and $c_4h(t)*x(t)$ is a reflected wave arriving at the microphone 1501 (#2). Therefore, assuming signals recorded by the microphones 1501 (#1) and (#2) as l(t) and r(t), respectively, l(t) and r(t) can be expressed as the linear sum of the direct wave and the reflected wave as in the following equations.

$$l(t)=c_1x(t)+c_2h(t)*x(t) \quad \text{[Equation 1]}$$

$$r(t)=c_3x(t)+c_4h(t)*x(t) \quad \text{[Equation 2]}$$

Since an HE-AAC v2 decoder cannot obtain a signal corresponding to the sound source x(t) in FIG. 15, a stereo signal is generated approximately from a monaural signal s(t), as in the following equation. In Equation 3 and Equation 4, each first term approximates the direct wave and each second term approximates the reflected wave (reverberation component).

$$l'(t)=c_1's(t)+c_2'h(t)*s(t) \quad \text{[Equation 3]}$$

$$r'(t)=c_3's(t)+c_4'h=(t)*s(t) \quad \text{[Equation 4]}$$

While there are various methods for generating a reverberant component, a parametric stereo (hereinafter, may be abbreviated as "PS" as needed) decoding unit in accordance with the HE-AAC v2 standard generates a reverberation component d(t) by decorrelating (orthogonalizing) a monaural signal s(t), and generates a stereo signal in accordance with the following equations.

$$l'(t)=c_1's(t)+c_2'd(t) \quad \text{[Equation 5]}$$

$$r'(t)=c_3's(t)+c_4'd(t) \quad \text{[Equation 6]}$$

While the process has been explained as performed in the time region for explanatory purpose, the PS decoding unit performs the conversion to pseudo-stereo in a time-frequency region (Quadrature Mirror Filterbank (QMF) coefficient region), so Equation 5 and Equation 6 are expressed as follows, where b is an index representing the frequency, and t is an index representing the time.

$$l'(b,t)=h_{11}s(b,t)+h_{12}d(b,t) \quad \text{[Equation 7]}$$

$$r'(b,t)=h_{21}s(b,t)+h_{22}d(b,t) \quad \text{[Equation 8]}$$

Next, a method for generating a reverberation component d(b,t) from a monaural signal s(b,t) is described. While there are various method for generating a reverberation component, the PS decode unit in accordance with the HE-AAC v2 standard converts the monaural signal s(b,t) into the reverberation component d(b,t) by decorrelating (orthogonalizing) it using an IIR (Infinite Impulse Response)-type all-pass filter, as illustrated in FIG. 16.

The relationship between input signals (L, R), a monaural signal s and a reverberation component d is illustrated in FIG. 17. As illustrated in FIG. 17, the angle between the input signals L, R and the monaural signal s is assumed as $\alpha$, and the degree of similarity is defined as $\cos(2\alpha)$. An encoder in accordance with the HE-AAC v2 standard encodes $\alpha$ as the similarity information. The similarity information represents the similarity between the L-channel input signal and the R-channel input signal.

FIG. 17 illustrates, for the sake of simplification, an example of a case in which the lengths of L and R are the same. However, in consideration of a case in which the lengths (norms) of L and R are different, the ratio of the norms of L and R is defined as an intensity difference, and the encoder encodes it as the intensity difference information. The intensity difference information represents the power ratio of the L channel input signal and the R channel input signal.

A method for generating a stereo signal from s(b,t) and d(b,t) at the decoder side is described. In FIG. 18, S is a decoded input signal, D is a reverberation signal obtained at the decoder side, $C_L$ is a scale factor of the L channel signal calculated from the intensity difference. A vector obtained by combining the result of the projection, in the direction of the angle $\alpha$, of the monaural signal that has been subjected to scaling using $C_L$, and the result of the projection, in the direction of $(\pi/2)-\alpha$, of the reverberant signal that has been subjected to scaling using $C_L$ is regarded as the decoded L channel signal, which is expressed as Equation 9. In the same manner, the R channel may also be generated in accordance with Equation 10 below using the scale factor $C_R$, S, D and the angle $\alpha$. There is a relationship $C_L+C_R=2$ between $C_L$ and $C_R$.

$$\begin{aligned} L'(b,t) &= C_L s(b,t)\cos\alpha + C_L d(b,t)\cos\left(\frac{\pi}{2}-\alpha\right) \\ &= C_L s(b,t)\cos\alpha + C_L d(b,t)\sin\alpha \end{aligned} \quad \text{[Equation 9]}$$

$$\begin{aligned} R'(b,t) &= C_R s(b,t)\cos(-\alpha) - C_R d(b,t)\cos\left(\frac{\pi}{2}-\alpha\right) \\ &= C_R s(b,t)\cos(-\alpha) + C_R d(b,t)\sin(-\alpha) \end{aligned} \quad \text{[Equation 10]}$$

Therefore, Equation 9 and Equation 10 can be put together as Equation 11.

$$\begin{bmatrix} L'(b,t) \\ R'(b,t) \end{bmatrix} = \begin{bmatrix} h_{11} & h_{12} \\ h_{21} & h_{22} \end{bmatrix} \begin{bmatrix} s(b,t) \\ d(b,t) \end{bmatrix} \quad \text{[Equation 11]}$$

where $$h_{11} = C_L\cos\alpha, \quad h_{12} = C_L\sin\alpha$$
$$h_{21} = C_R\cos(-\alpha), \quad h_{22} = C_R\sin(-\alpha)$$

A conventional example of a parametric stereo decoding apparatus that operates in accordance with the principle described above is explained below.

FIG. 19 is a configuration diagram of a conventional parametric stereo decoding apparatus.

First, a data separation unit 1901 separates received input data into core encoded data and PS data.

A core decoding unit 1902 decodes the core encoded data, and outputs a monaural sound signal S(b), where b is an index of the frequency band. As the core decoding unit, one in accordance with the conventional audio coding/decoding system such as the AAC (Advanced Audio Coding) system and the SBR (Spectral Band Replication) system.

The monaural sound signal S(b) and the PS data are input to a parametric stereo (PS) decoding unit 1903.

The PS decoding unit 1903 converts the monaural signal S(b) into stereo decoded signals L(b) and R(b), on the basis of the information of the PS data.

Frequency-time conversion units 1904(L) and 1904(R) convert the L-channel frequency region decoded signal L(b) and the R-channel frequency region decoding signal R(b) into an L channel time region decoded signal L(t) and an R channel time region decoded signal R(t), respectively.

FIG. 20 is a configuration diagram of the PS decoding unit 1903 in FIG. 19.

In accordance with the principle mentioned in the description of FIG. 16, to the monaural signal S(b), a delay is applied by a delay adder 2001, and decorrelation is performed by a decorrelation unit 2002, to generate the reverberation component D(b).

In addition, a PS analysis unit 2003 analyzes PS data to extract the degree of similarity and the intensity difference. As mentioned above in the description of FIG. 17, the degree of similarity represents the degree of similarity of the L-channel signal and the R-channel signal (which is a value calculated from the L-channel signal and the R-channel signal and quantized, at the encoder side), and the intensity difference represents the power ratio between the L-channel signal and the R-channel signal (which is a value calculated from the L-channel signal and the R-channel signal and quantized in the encoder).

A coefficient calculation unit 2004 calculates a coefficient matrix H from the degree of similarity and the intensity difference, in accordance with Equation 11 mentioned above.

A stereo signal generation unit 2005 generates stereo signals L(b) and R(b) on the basis of the monaural signal S(b), the reverberation component D(b) and the coefficient matrix H, in accordance with Equation 12 below that is equivalent to Equation 11 described above.

$$L(b)=h_{11}S(b)+h_{12}D(b)$$

$$R(b)=h_{21}S(b)+h_{22}D(b) \quad \text{[Equation 12]}$$

Studied below is a case in which, in the conventional art of the parametric stereo system described above, stereo signal having little correlation between an L-channel input signal and an R-channel input signal, such as a two-language sound is encoded.

Since the stereo signal is generated from a monaural signal S at the decoder side in the parametric stereo system, the characteristics of the monaural signal S have influence on output signals L' and R', as can be understood from Equation 12 mentioned above.

For example, when the original L-channel input signal and R-channel signal are completely different (i.e., the degree of similarity is zero), the output sound from the PS decoding unit 1903 in FIG. 19 is calculated in accordance with the following equation.

$$L'(b)=h_{11}S(b)$$

$$R'(b)=h_{21}S(b) \quad \text{[Equation 13]}$$

The component of the monaural signal S appears in the output signals L' and R', which is schematically illustrated in FIG. 21. Since the monaural signal S is the sum of the L-channel input signal and the R-channel input signal, Equation 13 indicates that one signal leaks in the other channel.

For this reason, in the conventional parametric stereo decoding apparatus, there has been a problem that when listening output signals L' and R' at the same time, similar sounds are generated from left and right, creating an echo-like sound and leading to the deterioration of the sound quality.

[Patent document 1]: Japanese Laid-open Patent Application No. 2007-79483

SUMMARY

An objective of an embodiment of the present invention is to reduce the deterioration of sound quality in a sound decoding system, such as the parametric stereo system, in which an original sound signal is recovered at the decoding side on the basis of a decoded sound signal and a sound decoding auxiliary information.

A first aspect is provided as a sound decoding apparatus decoding a first decoded sound signal and a first sound decoding auxiliary information from encoded sound data, and decoding a second decoded sound signal on the basis of the first decoded sound signal and the first sound decoding auxiliary information; or a sound decoding method or a sound decoding program that realizes the similar functions.

A decoded sound analysis unit (104) calculating a second sound decoding auxiliary information (109, 110) corresponding to the first sound decoding auxiliary information (107, 108) from the second decoding sound signal (L(b), R(b)).

A distortion detection unit (105, 503) detects, by comparing the second sound decoding auxiliary information and the first sound decoding auxiliary information, a distortion generated in a decoding process of the second decoded sound signal.

A distortion correction unit (105, 504) correcting, in the second decoding sound signal, a distortion detected by the distortion detection unit.

A second aspect is provided as a sound decoding apparatus decoding a monaural sound decoded signal and parametric stereo parameter information from sound data encoded in accordance with a parametric stereo system, and decoding a stereo sound decoded signal on the basis of the monaural sound decoded signal and the parametric stereo parameter information; or a sound decoding method or a sound decoding program that realizes the similar functions. The parametric stereo parameter information includes, for example, degree of similarity in formation and intensity difference information that represent the degree of similarity and the intensity difference between stereo sound channels.

A decoded sound analysis unit (104) calculates, using the parametric stereo parameter information as first parametric stereo parameter information, second parametric stereo parameter from the stereo sound decoded signal (L(b), R(b)) corresponding to the first parametric stereo parameter information. The decoded sound analysis unit calculates, for example, second degree of similarity information (109) and second intensity difference information (110) corresponding to first degree of similarity information (107) and first intensity difference information (108) that are the first parametric stereo parameter information from the stereo sound decoded signal (L(b), R(b)).

A distortion detection unit (105, 503) detects, by comparing the second parametric stereo parameter information and the first parametric stereo parameter information, a distortion generated in a decoding process of the stereo sound decoded signal. The distortion detection units detects, for example, by comparing the second degree of similarity information and the first degree of similarity information for respective frequency bands, a distortion in the respective frequency bands generated in the decoding process of the stereo sound decoded signal. More specifically, the distortion detection unit detects a distortion amount from a difference between the second degree of similarity information and the first degree of similarity information, and detects a distortion-generating stereo sound channel from a difference between the second intensity difference information and the first intensity difference information.

A distortion correction unit (105, 504) corrects, in the stereo sound decoded signal, a distortion detected by the distortion detection unit. The distortion correction unit corrects, for example, in the stereo sound decoded signal, the distortion in the respective frequency bands and in the respective stereo sound channels detected by the distortion detection unit. More specifically, the distortion correction unit determines a correction amount of the distortion in accordance with a distortion amount (and a power of the stereo sound decoded signal), and determines the stereo sound channel for which the correcting is to be performed on the basis of a distortion-generating stereo sound channel.

The configuration according to the second aspect described above may further include a smoothing unit (1201, 1202) smoothing, in a time axis direction or a frequency axis direction, the stereo sound decoded signal having been subjected to a correction by the distortion correction unit.

The configuration according to the second aspect described above may be made so that the decoded sound analysis unit, the distortion detection unit and the distortion correction unit is realized in a time-frequency region.

According to an embodiment of the present invention, in a sound decoding system in which a stereo sound decoded signal and the like is decoded by applying processes such as pseudo-stereo conversion to a monaural sound decoded signal and the like on the basis of first parametric stereo parameter information and the like, it becomes possible to detect a distortion in the decoding process such as the pseudo-stereo conversion process, by generating second parametric stereo parameter information and the like corresponding to the first parametric stereo parameter information and the like from the stereo sound decoded signal, and comparing the first and second parametric stereo parameter information and the like.

This makes it possible to apply spectrum correction to the stereo sound decoded signal for eliminating echo feeling and the like, and to suppress the deterioration of sound quality of the decoded sound.

DESCRIPTION OF EMBODIMENTS

Hereinafter, the best modes for carrying out an embodiment of the present invention is described in detail, with reference to the drawings.

Description of Principle

Figure 1:
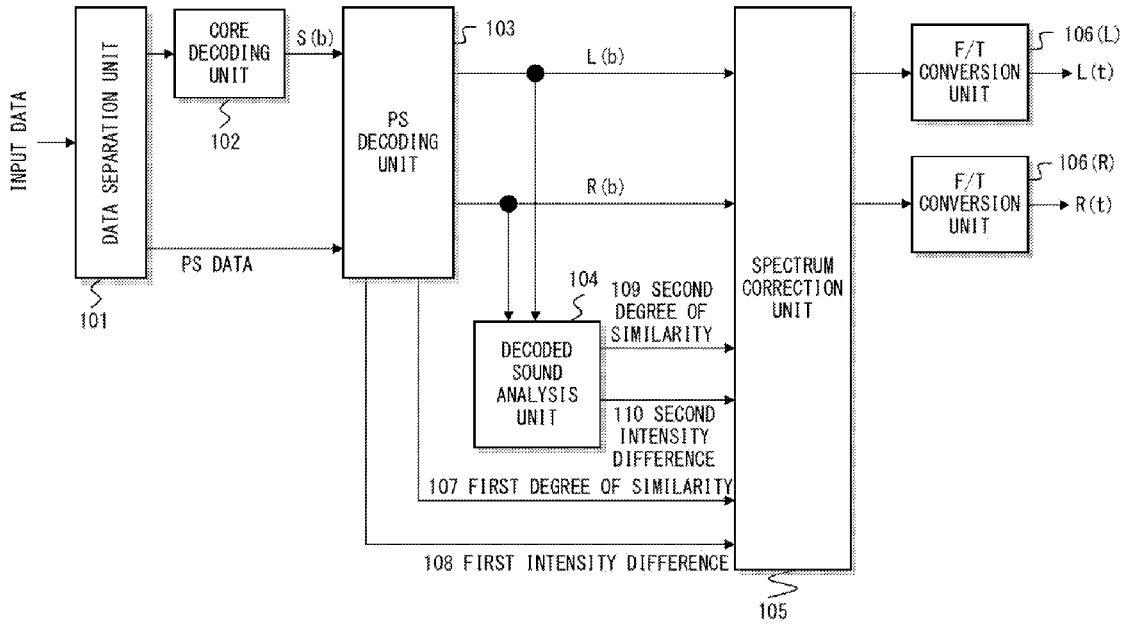
FIG. 1 is a principle configuration diagram of a parametric stereo decoding apparatus.
Figure 2:
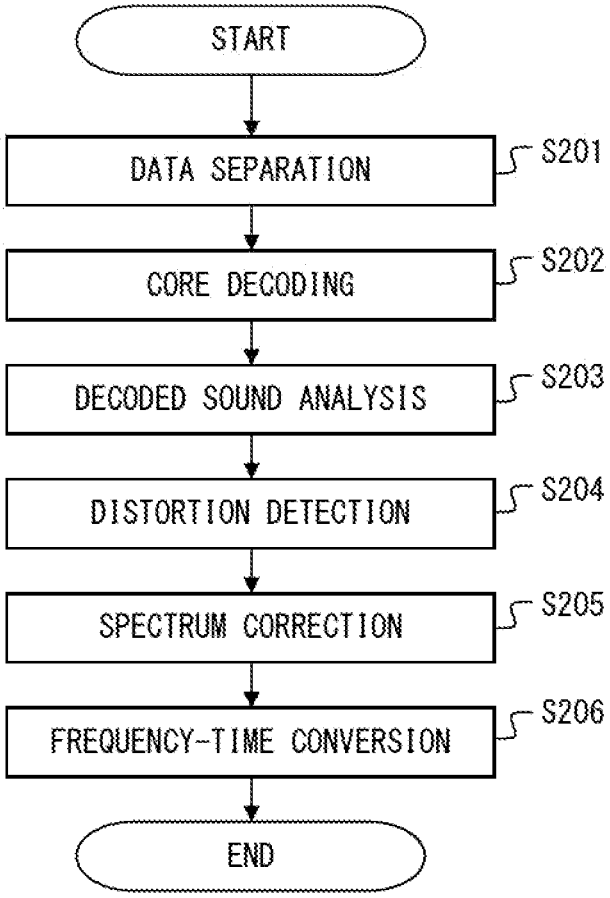
FIG. 2 is an operation flowchart illustrating the principle operations of an embodiment of a parametric stereo decoding apparatus.

First, the principle of the present embodiment is described. FIG. 1 is a principle diagram of the embodiment of a parametric stereo decoding apparatus, and FIG. 2 is an operation flowchart illustrating the summary of its operations. In the description below, reference is made to each of 101-110 in FIG. 1 and blocks S201-S206 in FIG. 2, as needed.

Figure 19:
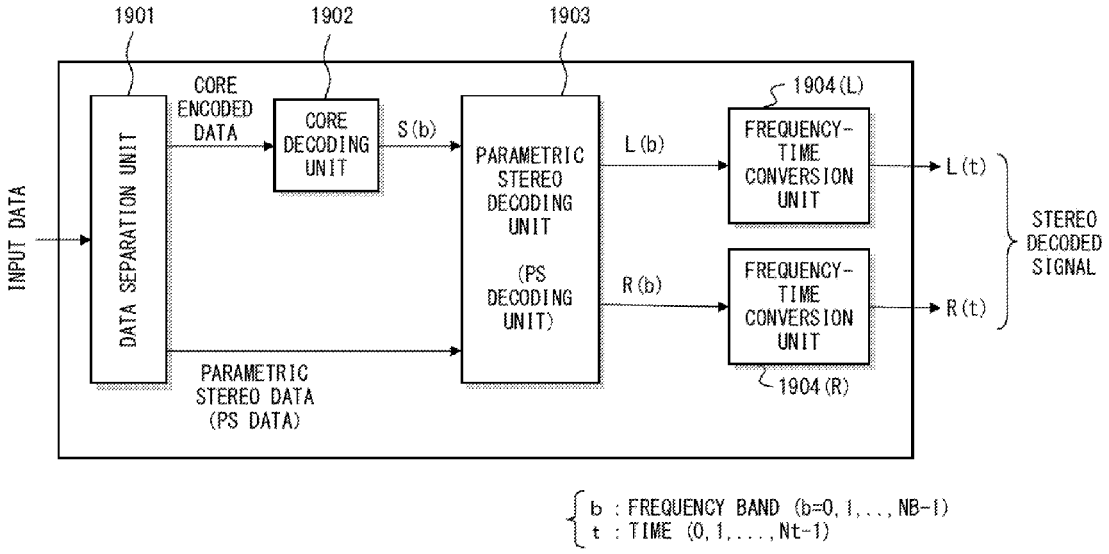
FIG. 19 is a configuration diagram of a conventional parametric stereo diagram.
Figure 20:
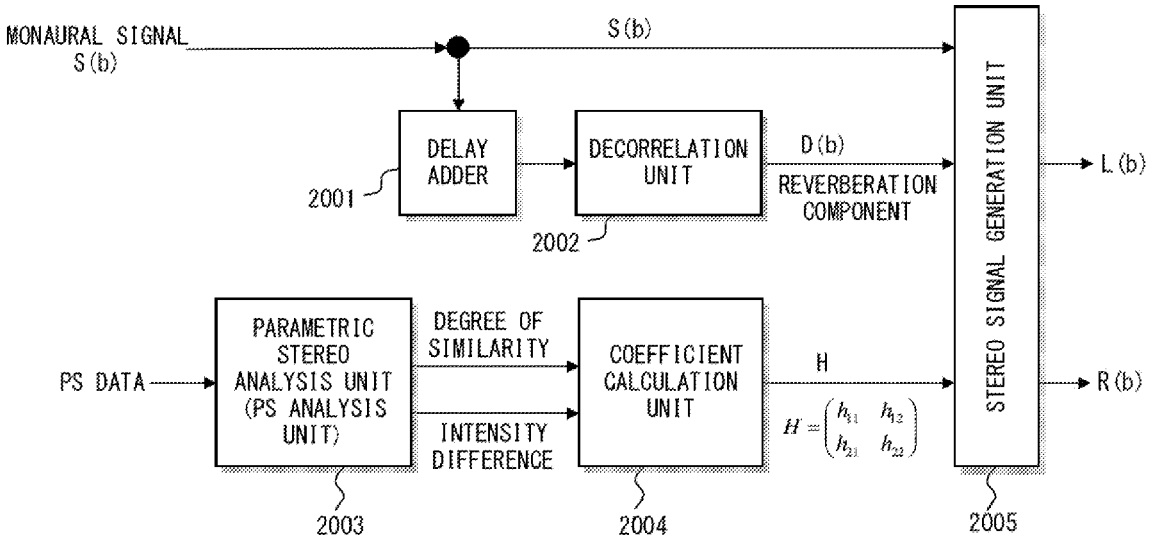
FIG. 20 is a configuration diagram of a PS decoding unit 1903 in FIG. 19.
Figure 21:
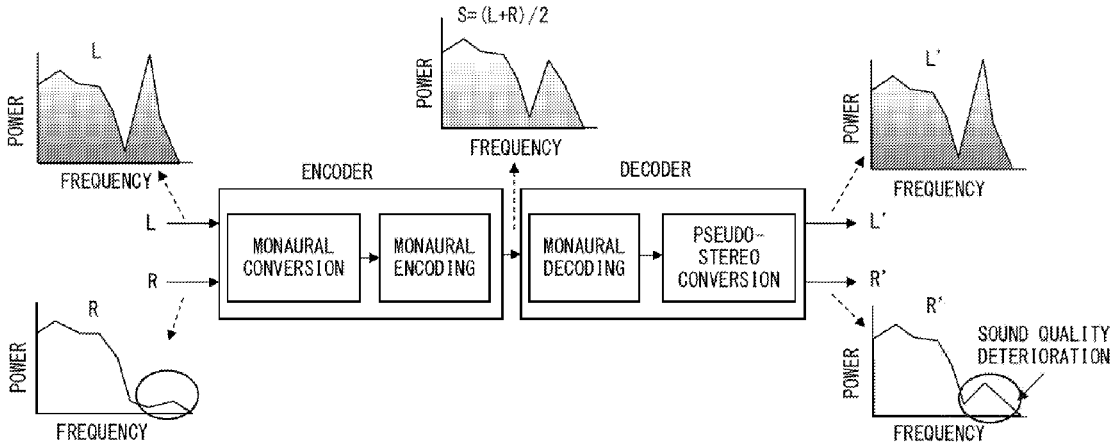
FIG. 21 is an explanatory diagram of the problem of the conventional art.

First, a data separation unit 101 separates received input data into core encoded data and PS data (5201). This configuration is the same as that of the data separation unit 1901 in the conventional art described in FIG. 19.

A core decoding unit 102 decodes the core encoded data and outputs a monaural sound signal S(b) (S202), b representing the index of the frequency band. As the core decoding unit, ones based on a conventional audio encoding/decoding system such as the ACC (Advanced Audio Coding) system and SBR (Spectral Bank Replication) system can be used. The configuration is the same as that of the core decoding unit 1902 in the conventional art described in FIG. 19.

The monaural signal S(b) and the PS data are input to a parametric stereo (PS) decoding unit 103. The PS decoding unit 103 converts the monaural signal s(b) into frequency-region stereo signals L(b) and R(b) on the basis of the information in the PS data. The PS decoding unit 103 also extracts a first degree of similarity 107 and a first intensity difference 108 from the PS data. The configuration is the same as that of the core decoding unit 1903 in the conventional art described in FIG. 19.

A decoded sound analysis unit 104 calculates, regarding the frequency-region stereo signals L(b) and R(b) decoded by the PS decoding unit 103, a second degree of similarity 109 and a second intensity difference 110 from the decoded sound signals (S203).

A spectrum correction unit 105 detects a distortion added by the parametric-stereo conversion by comparing the second degree of similarity 109 and the second intensity difference 110 calculated at the decoding side with the first degree of similarity 107 and the first intensity difference 108 calculated and transmitted from the encoding side (S204), and corrects the spectrum of the frequency-region stereo decoded signals L(b) and R(b) (S205).

The decoded sound analysis unit 104 and the spectrum correction unit 105 are the characteristic parts of the present embodiment.

Frequency-time (F/T) conversion units 106(L) and 106(R) respectively convert the L-channel frequency-region decoded signal and the R-channel frequency-region decoded signal into an L-channel time-region decoded signal L(t) and an R-channel time-region decoded signal R(t) (S206). The configuration is same as that of the frequency-time conversion units 1904(L) and 1904(R) in the conventional art described in FIG. 19.

In the principle configuration described above, as illustrated in FIG. 3(*a*) for example, when the input stereo sound is a sound without echo feeling such as that of jazz music, the difference obtained as a result of comparison of a degree of similarity 301 before the encoding (degree of similarity calculated at encoding apparatus side) and a degree of similarity 302 after encoding (degree of similarity calculated at the decoding side from a parametric stereo decoded sound) is small. This is because, in the case of a sound such as the jazz sound illustrated in FIG. 3(*a*), the original sound before encoding has a large similarity between the L channel and R channel, making it possible for the parametric stereo to function well, and making the similarity between the L channel and R channel obtained by pseudo-decoding from transmitted and decoded monaural sound S(b) large as well. As a result, the difference between the similarities becomes small.

Figure 3:
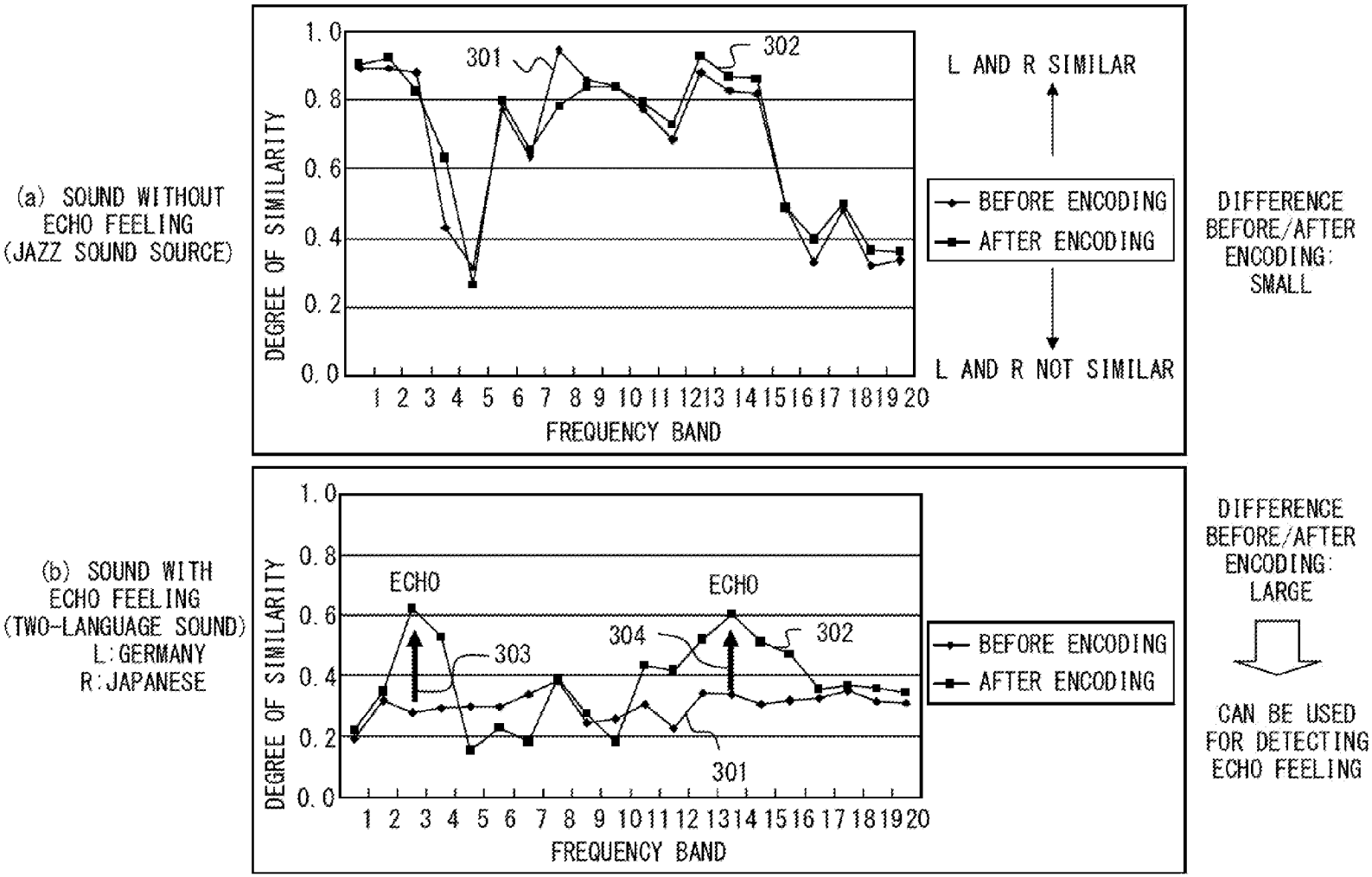
FIG. 3 is a diagram for explaining the principle of the embodiment of a parametric stereo decoding apparatus.

On the other hand, as illustrated in FIG. 3(*b*), in the case of a sound with echo feeling such as that of a two-language sound (L channel: German, R channel: Japanese), the difference obtained as a result of comparison of the degree of similarity 301 before encoding and the degree of similarity 302 after encoding for each frequency band becomes large in certain frequency bands (such as 303 and 304 in FIG. 3(*b*)). This is because, in the case of a sound such as the two-language sound illustrated in FIG. 3(*b*), the original input sound before encoding has a small similarity between the L channel and R channel, whereas the sound after the parametric stereo decoding has a large degree of similarity between the L channel and R channel, since both the L channel and R channel are obtained by pseudo-decoding from the transmitted and decoded monaural sound S(b). As a result, the difference between the degrees of similarity becomes large, which indicates that the parametric stereo is not functioning well.

In this regard, in the principle configuration in FIG. 1, the spectrum correction unit 105 compares the difference between the first degree of similarity 107 extracted from transmitted input data and the second degree of similarity 109 recalculated by the decoded sound analysis unit 104 from the decoded sound, and further decides which of the L channel and R channel is to be corrected, by judging the difference between the first intensity difference 108 extracted from transmitted input data and the first intensity difference 108 recalculated by the decoded sound analysis unit 104 from the decoded sound, to perform the spectrum correction (spectrum control) for each frequency band of either or both of the L-channel frequency-region decoded signal L(b) and the R-channel frequency decoded signal R(b).

Figure 4:
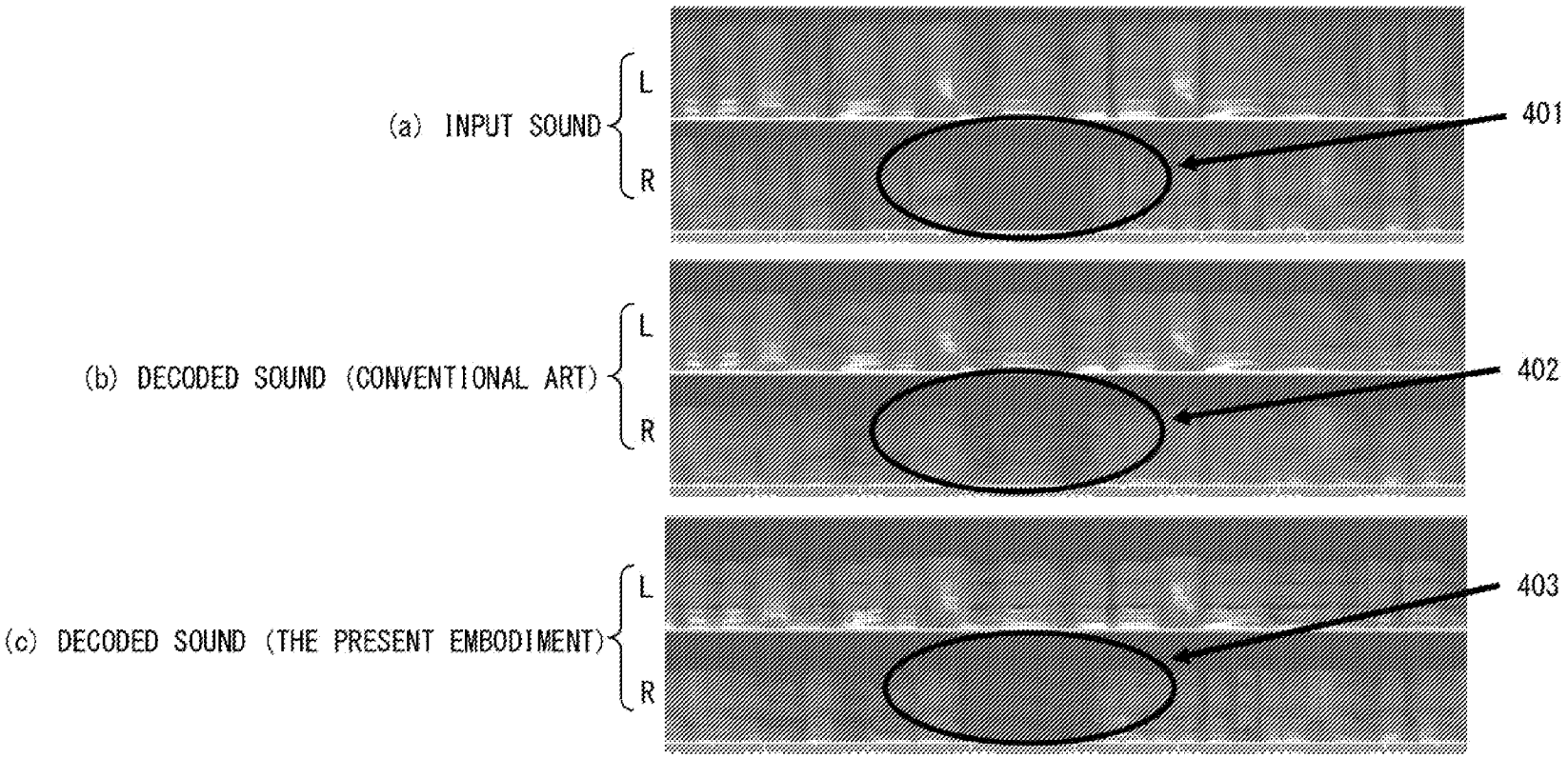
FIG. 4 is a diagram for explaining the effect of the embodiment of a parametric stereo decoding apparatus.

As a result, when the input stereo sound is a two-language sound (L channel: German, R channel: Japanese) as illustrated in FIG. 4, the difference between the sound components of the L channel and R channel becomes large in the frequency band illustrated in FIG. 401. Then, with the decoded sound in accordance with the conventional art, the sound component of the L channel leak in the R channel as a distortion component in a frequency band 402 corresponding to 401 in the input sound, as illustrated in FIG. 4(*b*), and simultaneous hearing of the L channel and R channel results in the perception of an echo-like sound. On the other hand, with the decoded sound obtained in accordance with the configuration in FIG. 1, the distortion component leaking in the R channel in the frequency band 402 corresponding to the 401 in the input sound due to the parametric stereo is well suppressed, resulting in the reduction of echo felling with the simultaneous hearing of the L channel and the R channel and virtually no subjective perception of degradation.

First Embodiment

Hereinafter, the first embodiment based on the principle configuration explained above is described.

Figure 5:
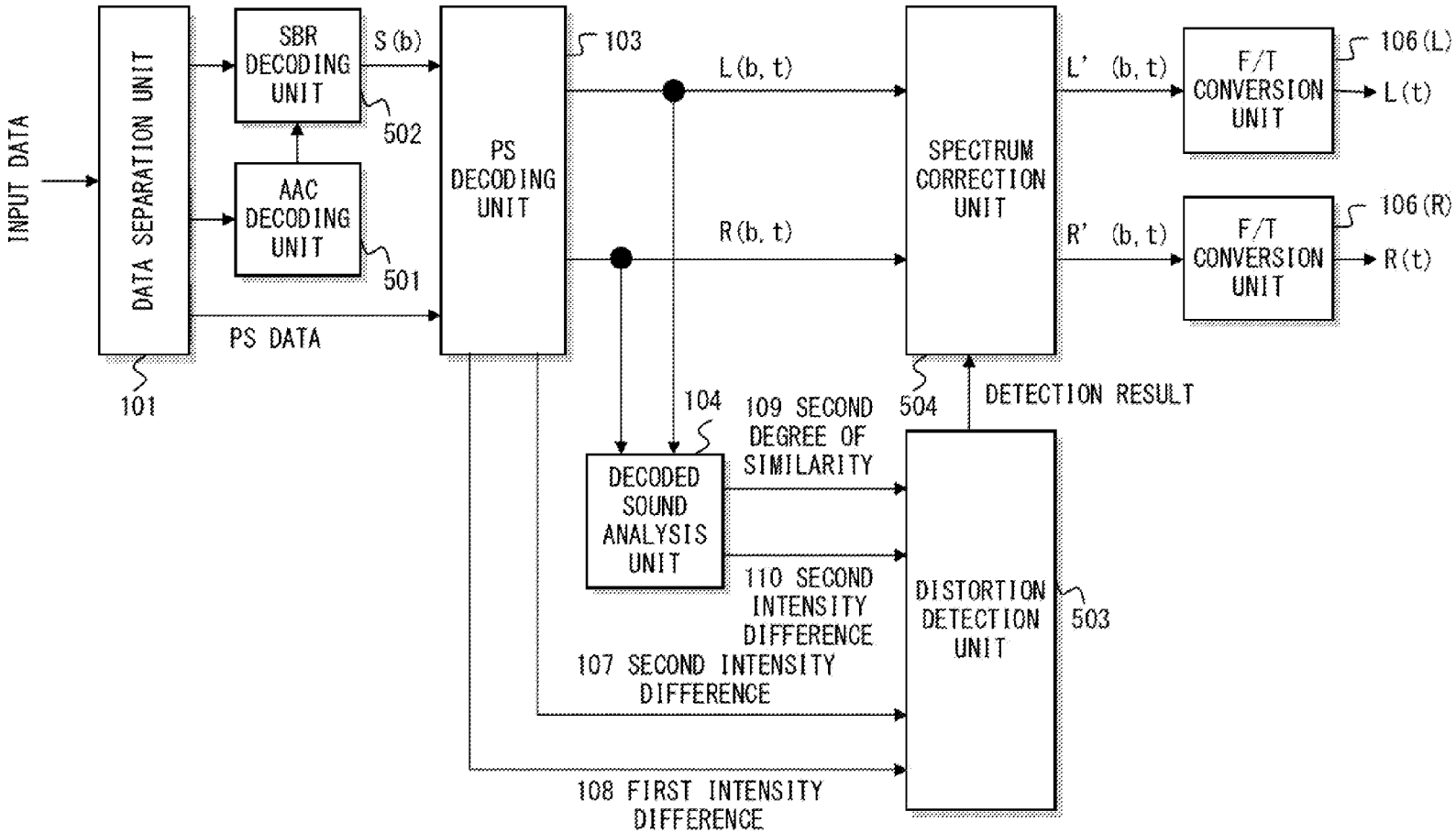
FIG. 5 is a configuration diagram of a first embodiment of a parametric stereo decoding apparatus.

FIG. 5 is a configuration diagram of a first embodiment of a parametric stereo decoding apparatus based on the principle configuration in FIG. 1

It is assumed that in FIG. 5, the parts having the same numbers as those in the principle configuration in FIG. 1 have the same function as in FIG. 1.

In FIG. 5, the core decoding unit 102 in FIG. 1 is embodied as an ACC decoding unit 501 and an SBR decoding unit 502, and the spectrum correction unit 105 in FIG. 1 is embodied as a correction detection unit 503 and a spectrum correction unit 504.

The ACC decoding unit 501 decodes a sound signal encoded in accordance with the ACC (Advanced Audio Coding) system. The SBR decoding unit 502 further decodes a sound signal encoded in accordance with the SBR (Spectral Band Replication) system, from the sound signal decoded by the ACC decoding unit 501.

Next, detail operations of the decoded sound analysis unit 104, the distortion detection unit 503, and the spectrum correction unit 504, on the basis of FIGS. 6-10.

First, in FIG. 5, stereo decoded signals output from the PS decoding unit 103 are assumed as an L-channel decoded signal L(b,t) and an R-channel decoded signal R(b,t), where b is an index indicating the frequency band, and t is an index indicating the discrete time.

Figure 6:
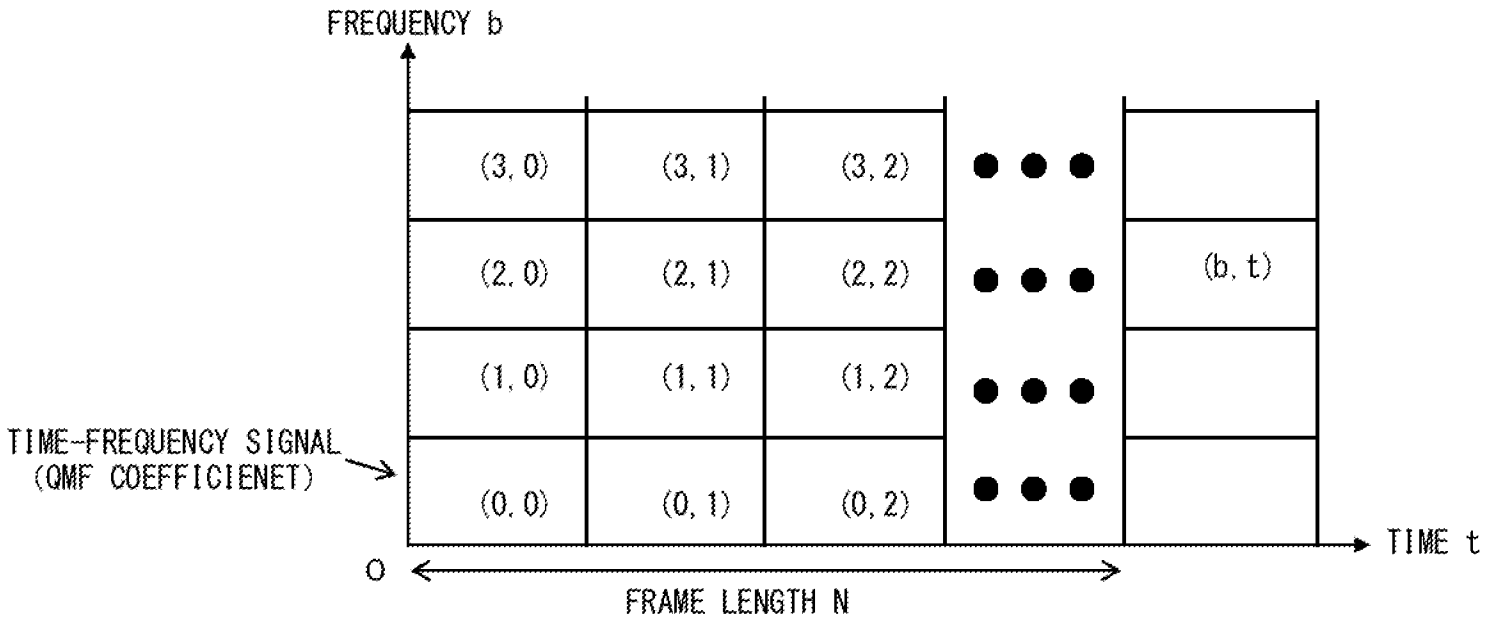
FIG. 6 is a diagram illustrating the definition of a time-frequency signal in an HE-AAC decoder.

FIG. 6 is a diagram illustrating the definition of a time-frequency signal in an HE-AAC decoder. Each of the signals L(b,t) and R(b,t) is composed of a plurality of signal components divided with respect to frequency band b for each discrete time. A time-frequency signal (corresponding to a QMF (Quadrature Mirror Filterbank) coefficient) is expressed using b and t, such as L(b,t) or R(b,t) as mentioned above. The decoded sound analysis unit 104, the distortion detection unit 503, and the spectrum correction unit 504 perform a series of processes described below for each discrete time t. The series of processes may be performed for each predetermined time length, while being smoothed in the direction of the discrete time t, as explained later for a third embodiment Now, assuming the intensity difference between the L channel and R channel in a given frequency band b as IID(b) and the degree of similarity as ICC(b), the IID(b) and the ICC(b) are calculated in accordance with Equation 14 below, where N is a frame length in the time direction (see FIG. 6).

[Equation 14]

$$IID(b) = 10\log_{10}\frac{e_L(b)}{e_R(b)}$$

$$ICC(b) = \frac{\mathrm{Re}\{e_{LR}(b)\}}{\sqrt{e_L(b)e_R(b)}}$$

$$e_L(b) = \sum_{t=0}^{N-1} L^*(b,t)L(b,t)$$

$$e_R(b) = \sum_{t=0}^{N-1} R^*(b,t)R(b,t)$$

$$e_{LR}(b) = \sum_{t=0}^{N-1} L(b,t)R^*(b,t)$$

As can be understood from the equations, the intensity difference IID(b) is the logarithm ratio between an average power $e_L(b)$ of the L-channel decoded signal L(b,t) and an average power $e_R(b)$ of the R-channel decoded signal R(b,t) in the current frame ($0 \le t \le N-1$) in the frequency band b and the degree of similarity ICC(b) is the cross-correlation between these signals.

The decoded sound analysis unit 104 outputs the degree of similarity ICC(b) and the intensity difference IID(b) as a second degree of similarity 109 and a second intensity difference 110, respectively.

Figure 7:
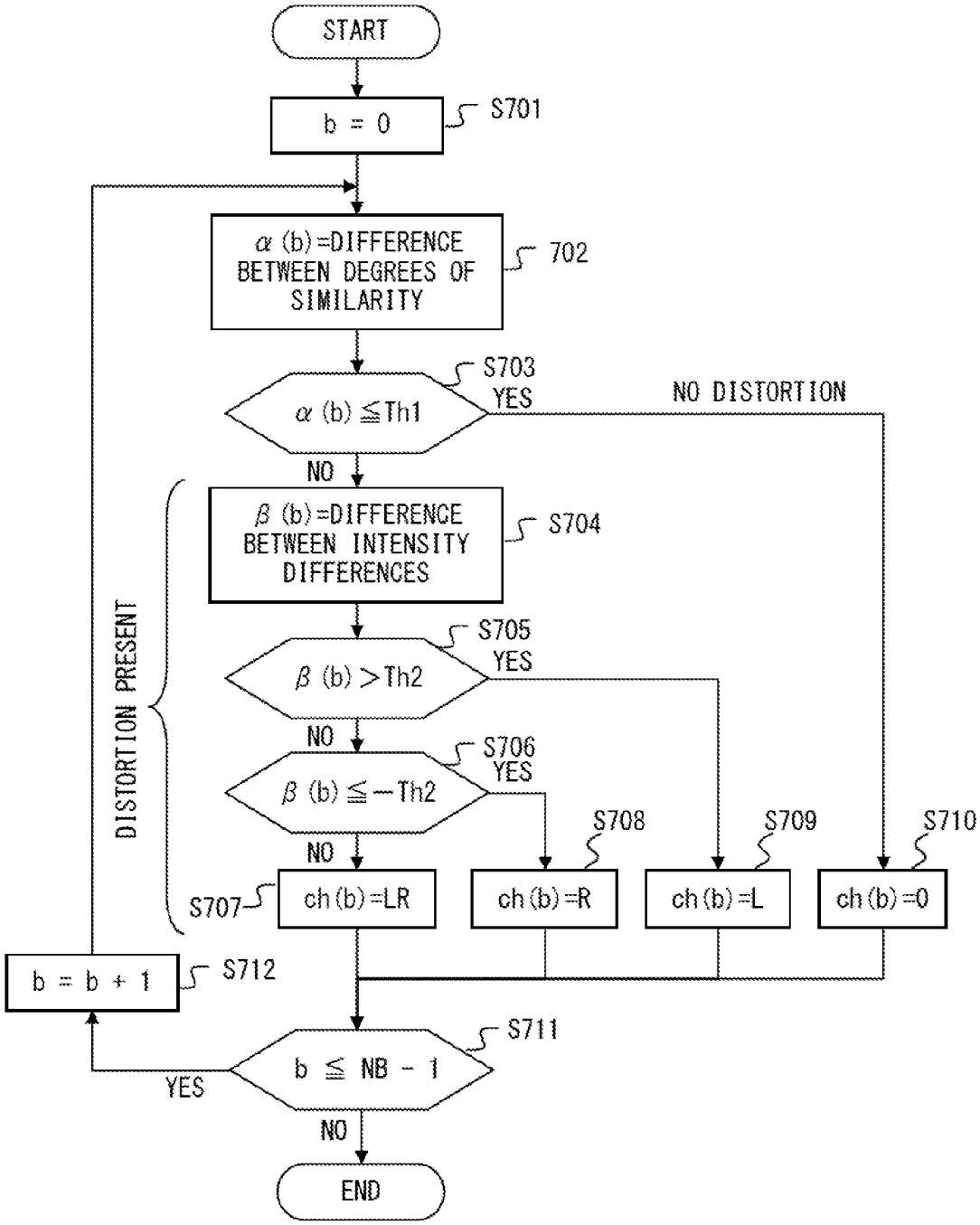
FIG. 7 is an operation flowchart illustrating the controlling operation of a distortion detection unit 503.

Next, the distortion detection unit 503 detects a distortion amount α(b) and a distortion-generating channel ch(b) in each frequency band b for each discrete time t, in accordance with the operation flowchart in FIG. 7. In the following description, reference is made to blocks S701-S712 in FIG. 7 as needed.

Specifically, the distortion detection unit 503 initialize the frequency band number to 0 in block S701, and then performs a series of processes S702-S710 for each frequency band b, while increasing the frequency band number by one at block S712, until it determines that the frequency band number has exceeded a maximum value NB-1 in block S711.

First, the distortion detection unit 503 subtracts the value of the first degree of similarity 107 output from the PS decoding unit 103 in FIG. 5 from the value of the second degree of similarity 109 output from the decoded sound analysis unit 104 in FIG. 5, to calculate the difference between the degrees of similarity in the frequency band b as the distortion amount α(b) (block S702).

Figure 8:
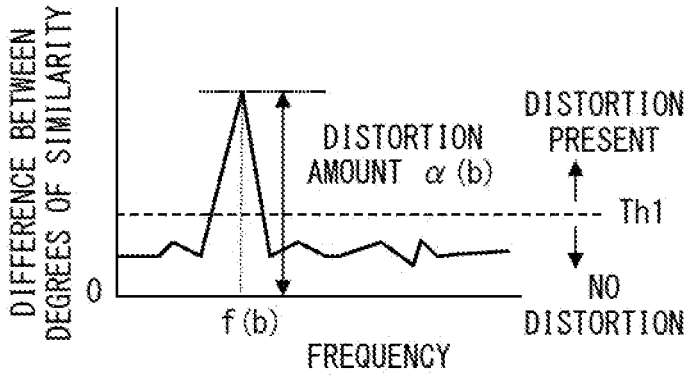
FIG. 8 is an explanatory diagram of the detection operation of a distortion amount and distortion-generating channel.
Figure 8:
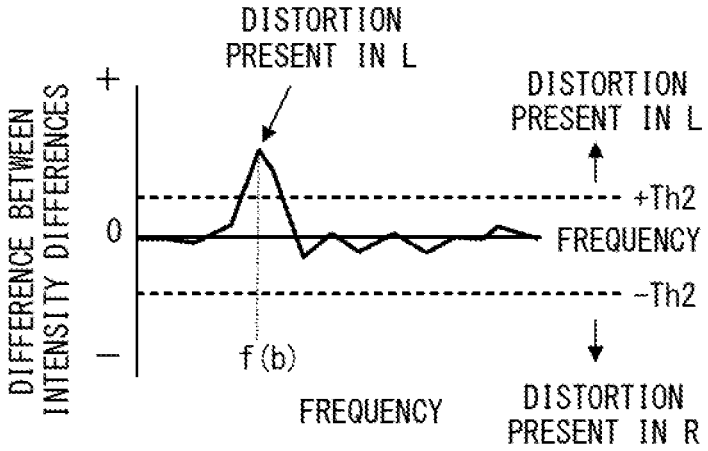

Next, the distortion detection unit 503 compares the distortion amount α(b) and a threshold value Th1 (block S703). Here, as illustrated in FIG. 8(*a*), it is determined that there is no distortion when the distortion amount α(b) is equal to or smaller than the threshold value Th1, and that there is a distortion when the distortion amount α(b) is larger than the threshold value Th1, which is based on the principle explained with FIG. 3.

In other words, the distortion detection unit 503 determines that there is no distortion when the distortion amount α(b) is equal to or smaller than the threshold value Th1 and sets 0, as a value instructing that no channel is to be corrected, to a variable ch(b) indicating a distortion-generating channel in the frequency band b, and then proceeds to the process for the next frequency band (block S703→S710→S711).

On the other hand, the distortion detection unit 503 determines that there is a distortion when the distortion amount α (b) is larger than the threshold value Th1, and performs the processes of blocks S704-S709 described below.

First, the distortion detection unit 503 subtracts the value of the first intensity difference 108 output from the PS decoding unit 103 in FIG. 5 from the value of the second intensity difference 110 output from the difference β(b) output from the decoded sound analysis unit 104 in FIG. 5 (block S704).

Next, the distortion detection unit 503 compares the difference β(b) to a threshold value Th2 and a threshold value −Th2, respectively (blocks S705 and S706). Here, as illustrated in FIG. 8(*b*), it is estimated that when the difference β(b) is larger than the threshold value Th2, there is a distortion in the L channel; if the difference β(b) is equal to or smaller than the threshold value −Th2, there is a distortion in the R channel; and when the difference β(b) is larger than the threshold value −Th2 and equal to or smaller than the threshold value Th2, there is a distortion in both the channels.

According to the equation for calculating the IID(b) in Equation 14 above, while a value of the intensity deference IID(b) being larger indicates that the L channel has a greater power, if the decoding side exhibits such a trend to a greater extent than the encoding side, i.e., if the difference β(b) exceeds the threshold value Th2, that means a greater distortion component is superimposed in the L channel. On the contrary, while a value of the intensity difference IID(b) being smaller indicates that the R channel has a greater power ratio, if the decoding side exhibits such a trend to a greater extent than the encoding side, i.e., if the difference β(b) is below the threshold value −Th2, that means the a greater distortion component is superimposed in the R channel.

In other words, the distortion detection unit 503 determines that there is a distortion in the L channel when the difference β(b) between the intensity differences is larger than the threshold value Th2, and sets a value L to the distortion-generating channel variable ch(b), and then proceeds to the process for the next frequency band (block S705→S709→S711).

In addition, the distortion detection unit 503 determines that there is a distortion in the R channel when the difference β(b) between the intensity differences is below the threshold value −Th2, and sets a value R to the distortion-generating channel variable ch(b), and then proceeds to the process for the next frequency band (block S705→S706→S708→S711).

The distortion detection unit 503 determines that there is a distortion in both the channels when the difference the difference β(b) between the intensity differences is larger than the threshold value −Th2 and equal to or smaller than the threshold value Th2, and sets a value LR to the distortion-generating channel variable ch(b), and then proceeds to the process for the next frequency band (block S705→S706→S707→S711).

Thus, the distortion detection unit 503 detects the distortion amount α(b) and the distortion-generating channel ch(b) of each frequency band b for each discrete time t, and then the values are transmitted to the spectrum correction unit 504.

The spectrum correction unit 504 then performs spectrum correction for each frequency band b on the basis of the values.

Figure 9:
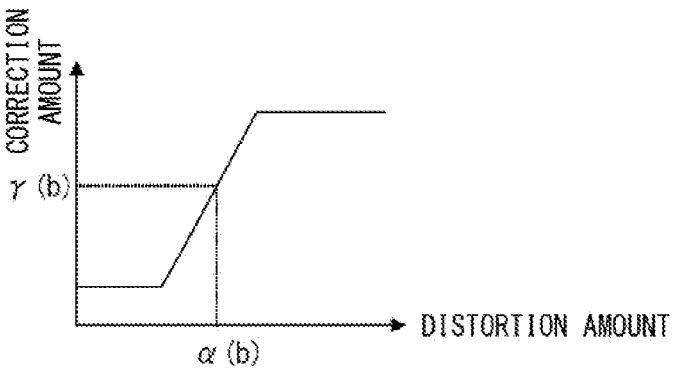
FIG. 9 is an explanatory diagram of the controlling operation of a spectrum correction unit 504.
Figure 9:
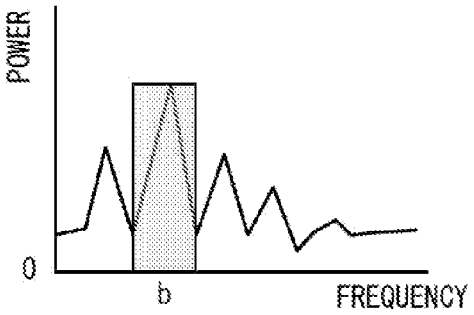
Figure 9:
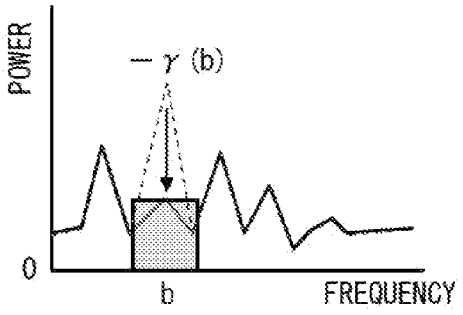

First, the spectrum correction unit 504 has a fixed table such as the one illustrated in FIG. 9(*a*) for calculating a spectrum correction amount γ(b) from the distortion amount α(b), for each frequency band b.

Next, the spectrum correction unit 504 refers to the table to calculate the spectrum correction amount γ(b) from the distortion amount α(b), and performs correction to reduce the spectrum value of the frequency band b by the spectrum correction amount γ(b) for the channel that the distortion-generating channel variable ch(b) specifies from the L-channel decoded signal L(b,t) and the R-channel decoded signal R(b,t) input from the PS decoding unit 103, as illustrated in FIGS. 9(*b*) and 9(*c*).

Then, the spectrum correction unit 504 outputs an L-channel decoded signal L'(b,t) or an R-channel decoded signal R'(b,t) that has been subjected to the correction as described above, for each frequency band b.

Figure 10:
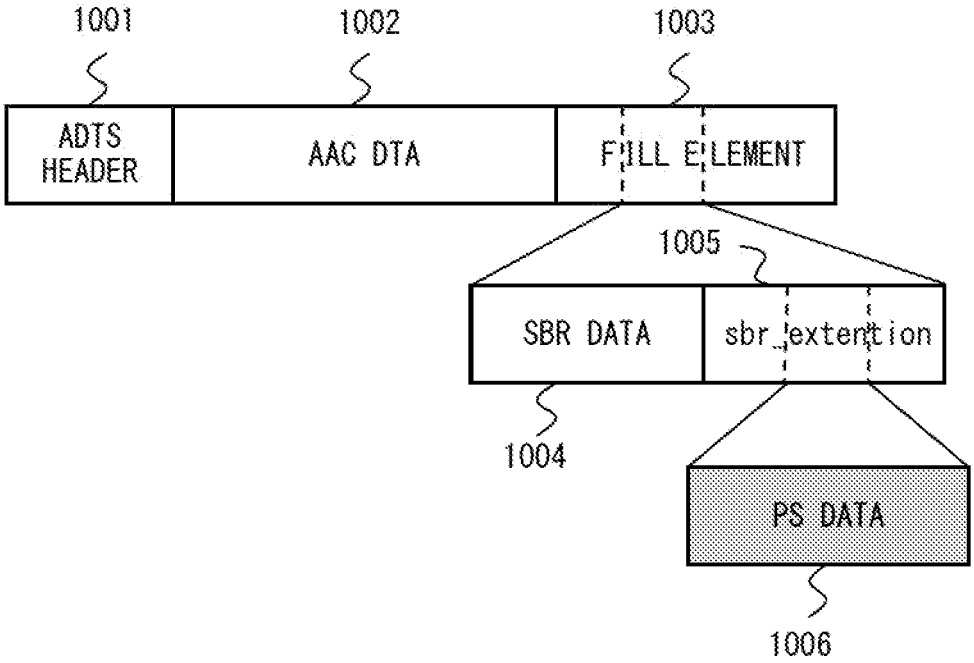
FIG. 10 is a diagram illustrating a data format example of input data.

FIG. 10 is a data format example of input data input to a data separation unit 101 in FIG. 5.

FIG. 10 displays a data format in an HE-AAC v2 decoder, in accordance with the ADTS (Audio Data Transport Stream) format adopted for the MPEG-4 audio.

Input data is composed of, generally, an ADTS header 1001, AAC data 1002 that is monaural sound AAC encoded data, and a extension data region (FILL element) 1003.

A part of the FILL element 1003 stores SBR data 1004 that is monaural sound SBR encoded data 1004, and extension data for SBR (sbr_extension) 1005.

The sbr_extension 1005 stores PS data for parametric stereo. The PS data stores the parameters such as the first degree of similarity 107 and the first intensity difference 108 required for the PS decoding process.

Second Embodiment

Next, second embodiment is described.

The configuration of the second embodiment is the same as that of the first embodiment illustrated in FIG. 5 except for the operation of the spectrum correction unit 504, so the configuration diagram is omitted.

While the correspondence relationship used in determining the correction amount γ(b) from the distortion amount α(b) is fixed in the spectrum correction unit 504 according to the first embodiment, an optical correspondence relationship is selected in accordance with the power of a decoded sound, in the second embodiment.

Figure 11:
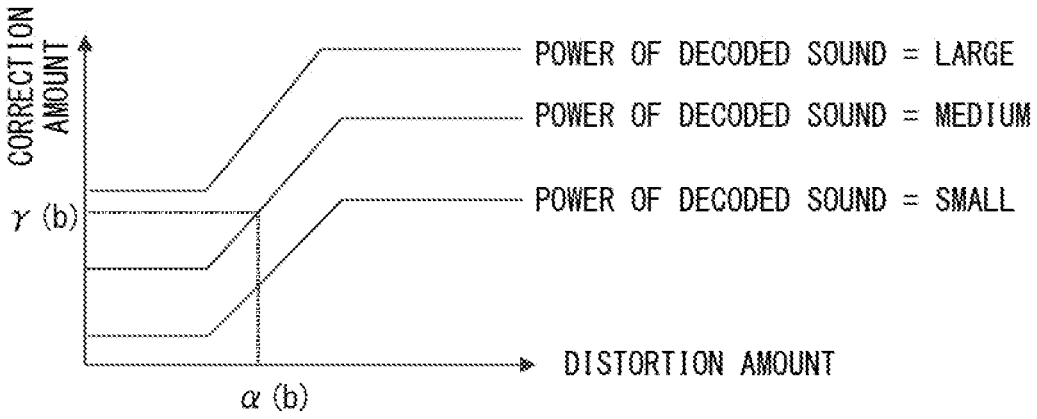
FIG. 11 is an explanatory diagram of a second embodiment.

Specifically, as illustrated in FIG. 11, a plurality of correspondence relationships are used, so that when the power of a decoded sound is large, the correction amount with respect to the distortion amount becomes large, and when the power of a decoded sound is small, the correction amount with respect to the distortion amount becomes small.

Here, the "power of a decoded sound" refers to the power in the frequency band b of the channel that is specified as the correction target, i.e., the L-channel decoded signal L(b,t) or the R-channel decoded signal R(b,t).

Third Embodiment

Next, a third embodiment is described.

Figure 12:
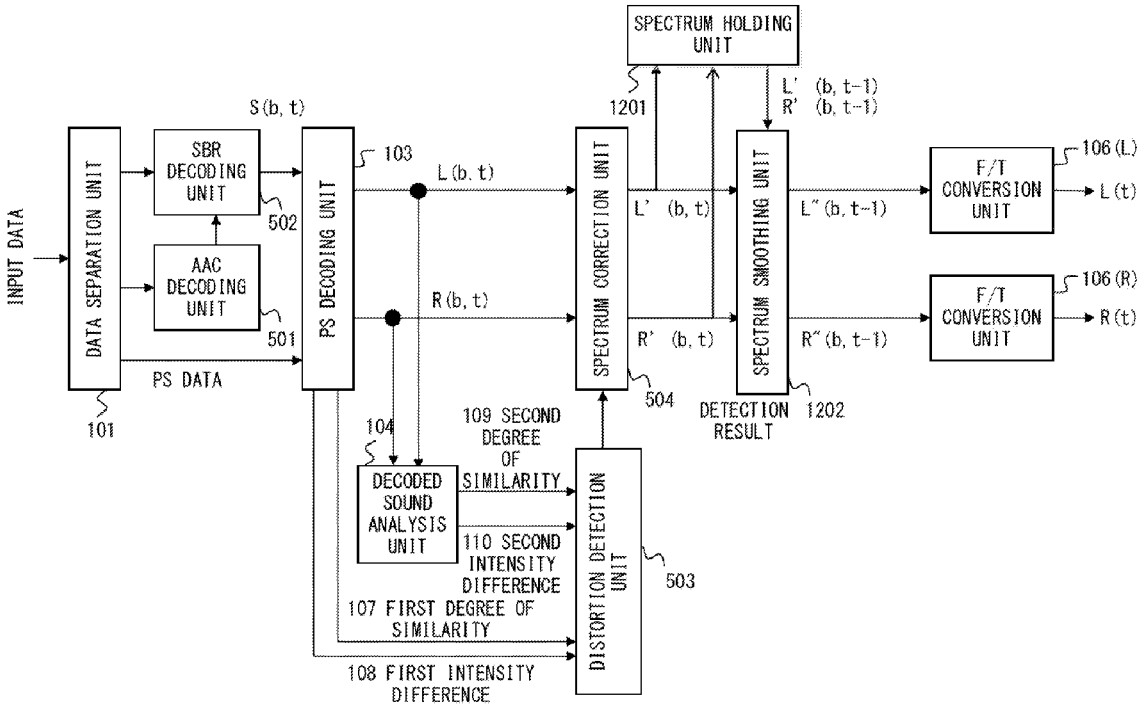
FIG. 12 is a configuration diagram of a third embodiment of a parametric stereo decoding apparatus.

FIG. 12 is a configuration diagram of third embodiment of a parametric stereo decoding apparatus.

It is assumed that in FIG. 12, the parts having the same numbers as those in the first embodiment in FIG. 5 have the same functions as those in FIG. 5.

The configuration in FIG. 12 differs from the configuration in FIG. 5 in that the former has a spectrum holding unit 1202 and a spectrum smoothing unit 1202 for smoothing corrected decoded signals L'(b,t) and R'(b,t) output from the spectrum correction unit 504 in the time-axis direction.

First, the spectrum holding unit 1203 constantly holds an L-channel corrected decoded signal L'(b,t) and an R-channel corrected decoded signal L'(b,t) output from the spectrum correction unit 504 in each discrete time t, and outputs an L-channel corrected decoded signal L'(b,t−1) and an R-channel corrected decoded signal R'(b,t−1) in a last discrete time, to the spectrum smoothing unit 1202.

The spectrum smoothing unit 1202 smoothes the L-channel corrected decoded signal L'(b,t−1) and the R-channel corrected decoded signal R'(b,t−1) in a last discrete time output from the spectrum holding unit 1202 using the L-channel corrected decoded signal L'(b,t) and the R-channel corrected decoded signal L'(b,t) output from the spectrum correction unit 504 in the discrete time t, and outputs them to F/T conversion units 106(L) and 106(R) as an L-channel corrected smoothed decoded signal L"(b,t−1) and an R-channel corrected smoothed decoded signal R"(b,t−1).

While any method can be used for the smoothing at the spectrum smoothing unit 1202, for example, a method calculating the weighted sum of the output from the spectrum holding unit 1202 and the spectrum correction unit 504 may be used.

In addition, outputs from the spectrum correction unit 504 for the past several frames may be stored in the spectrum holding unit 1202 and the weighted sum of the outputs for the several frames and the output from the spectrum correction unit 504 for the current frame may be calculated for the smoothing.

Furthermore, the smoothing for the output from the spectrum correction unit 504 is not limited to the time direction, and the smoothing process may be performed in the direction of the frequency band b. In other words, the smoothing may be performed for a spectrum of a given frequency band b in an output from the spectrum correction unit 504, by calculating the weighted sum with the outputs in the neighboring frequency band b−1 or b+1. In addition, spectrums of a plurality of neighboring frequency bands may be used for calculating the weighted sum.

Fourth Embodiment

Lastly, a fourth embodiment is described.

Figure 13:
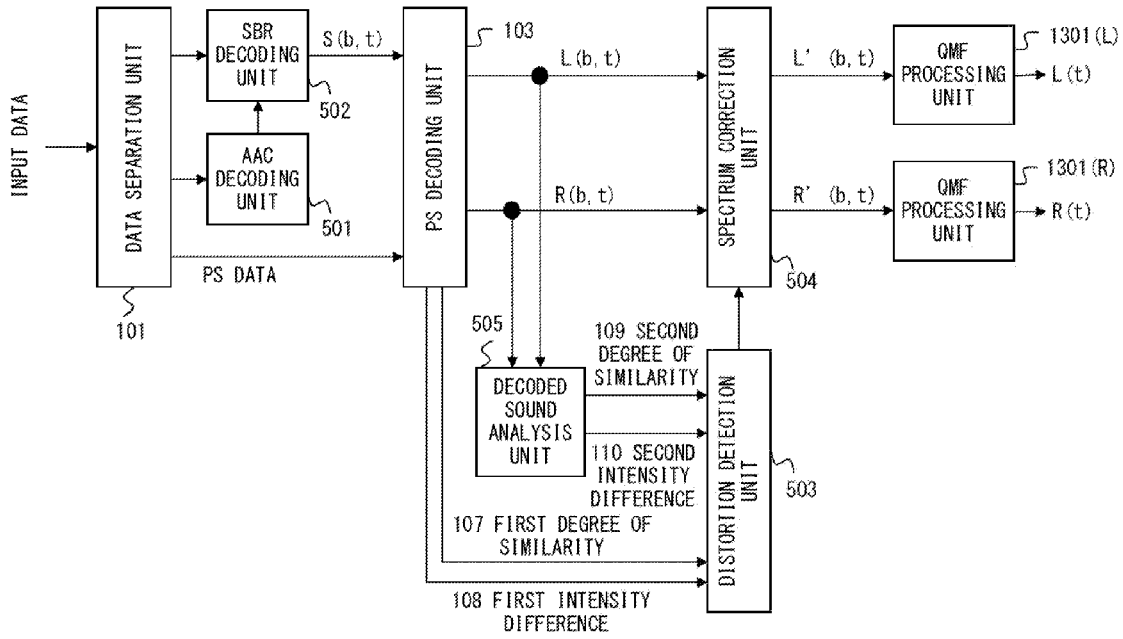
FIG. 13 is a configuration diagram of a fourth embodiment of a parametric stereo decoding apparatus.

FIG. 13 is a configuration diagram of a fourth embodiment of a parametric stereo decoding apparatus.

It is assumed that in FIG. 13, the parts having the same numbers as those the first embodiment in FIG. 5 have the same function as those in FIG. 5.

The configuration in FIG. 13 differs from the configuration in FIG. 5 in that in the former, QMF processing units 1301(L) and 1301(R) are used instead of the frequency-time (F/T) conversion units 106(L) and 106(R).

The QMF processing units 1301(L) and 1301(R) perform processes using QMF (Quadrature Mirror Filterbank) to convert the stereo decoded signals L'(b,t) and R'(b,t) that have been subjected to spectrum correction into stereo decoded signals L(t) and R(t).

First, spectrum correction method for a QMF coefficient is described.

In the same manner as in the first embodiment, a spectrum correction amount $\gamma_L$ (b) in the frequency band b in a given frame N is calculated, and correction is performed for a spectrum L(b,t) in accordance with the equation below. Here, it should be noted that a QMF coefficient of the HE-AAC v2 decoder is a complex number.

$$Re\{L_1'(b,t)\}=\gamma_L(b)\cdot Re\{L_1(b,t)\}$$

$$Im\{L_1'(b,t)\}=\gamma_L(b)\cdot Im\{L_1(b,t)\} \quad \text{[Equation 15]}$$

In the same manner, a spectrum correction amount $\gamma_R$(b) for the R channel is calculated, and a spectrum R(b,t) is corrected in accordance with the following equation.

$$Re\{R_1'(b,t)\}=\gamma_R(b)\cdot Re\{R_1(b,t)\}$$

$$Im\{R_1'(b,t)\}=\gamma_R(b)\cdot Im\{R_1(b,t)\} \quad \text{[Equation 16]}$$

The QMF coefficient is corrected by the processes described above. While the spectrum correction amount in a frame is explained as fixed in the fourth embodiment, the spectrum correction amount of the current frame may be smoothed using the spectrum correction amount of a neighboring (preceding/subsequent) frame.

Next, a method for converting the corrected spectrum to a signal in the time region by QMF is described below. The symbol j in the equation is an imaginary unit. Here, the resolution in the frequency direction (the number of the frequency band b) is 64.

$$L_2(t)=\sum_{b=0}^{63} L_1'(b,t)\cdot N(b,t) \quad \text{[Equation 17]}$$

$$R_2(t)=\sum_{b=0}^{63} R_1'(b,t)\cdot N(b,t)$$

$$N(b,t)=\frac{1}{64}\exp\left\{\frac{j\pi(b+0.5)(2t-255)}{128}\right\},$$

$$0\le b\le 64,\ 0\le t\le 128$$

Supplements to the First Through Fourth Embodiments

Figure 14:
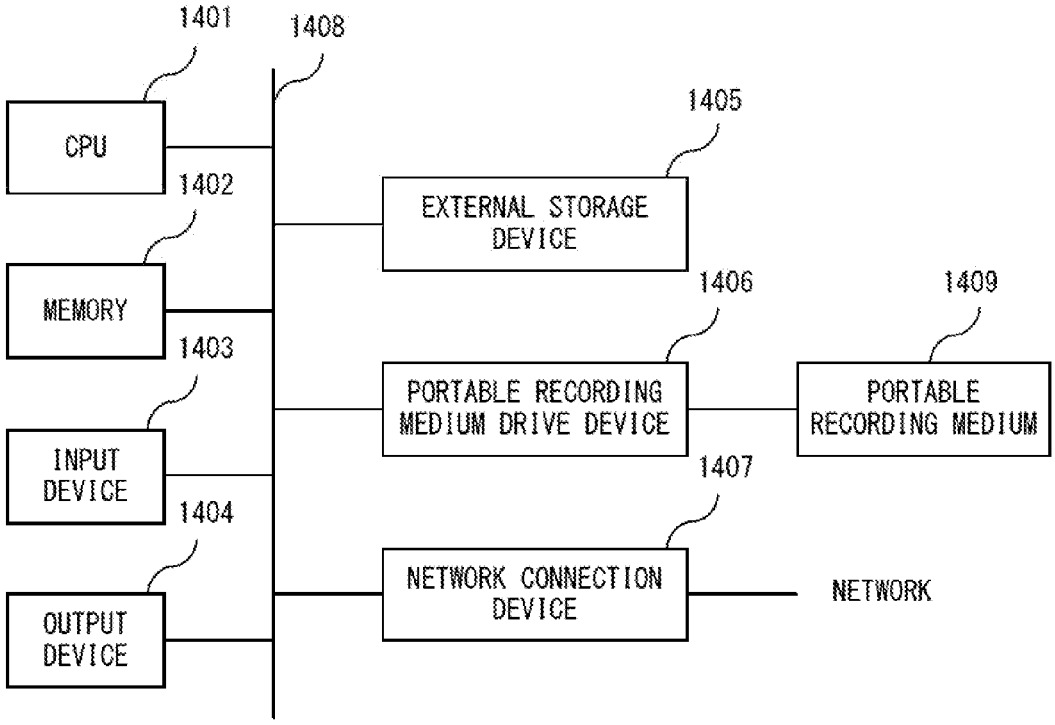
FIG. 14 is a diagram illustrating an example of a computer hardware configuration that can realize a system realized by the first through fourth embodiments.
Figure 15:
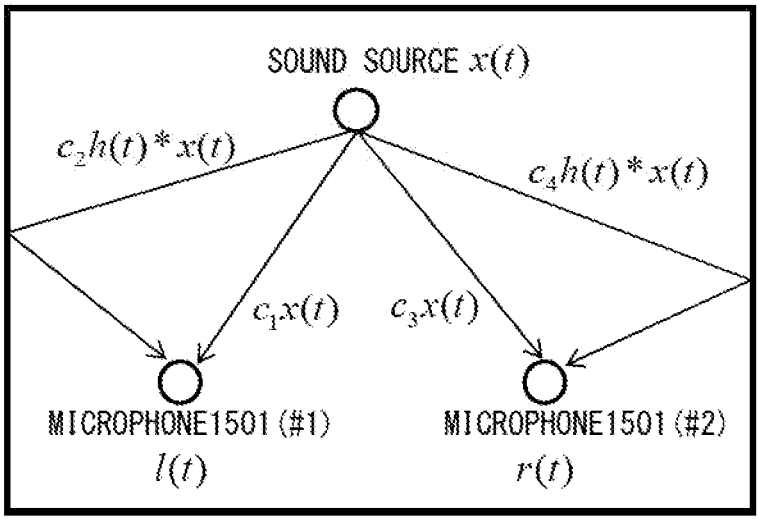
FIG. 15 is a diagram illustrating a model of stereo decoding.
Figure 16:
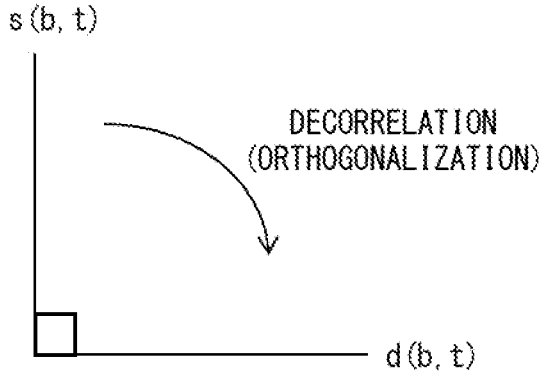
FIG. 16 is an explanatory diagram of decorrelation.
Figure 17:
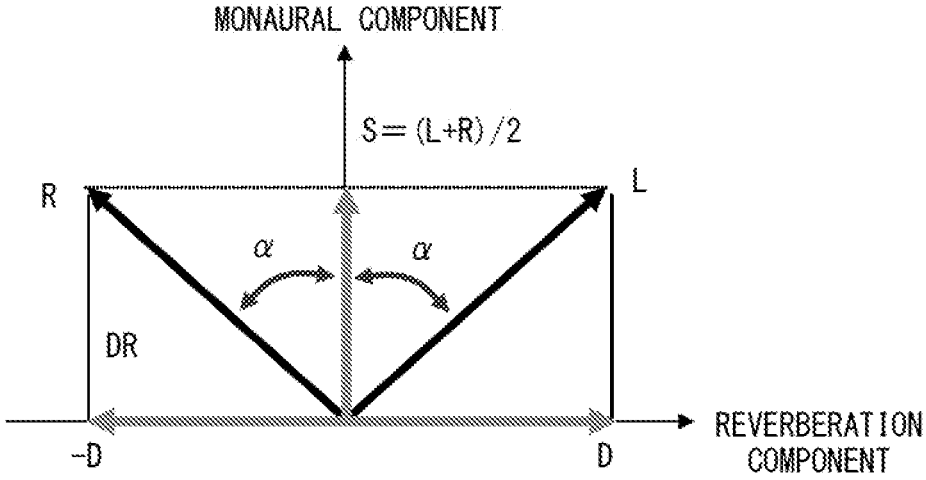
FIG. 17 is a relationship diagram of input signals (L,R), a monaural signal s and a reverberation component d.
Figure 18:
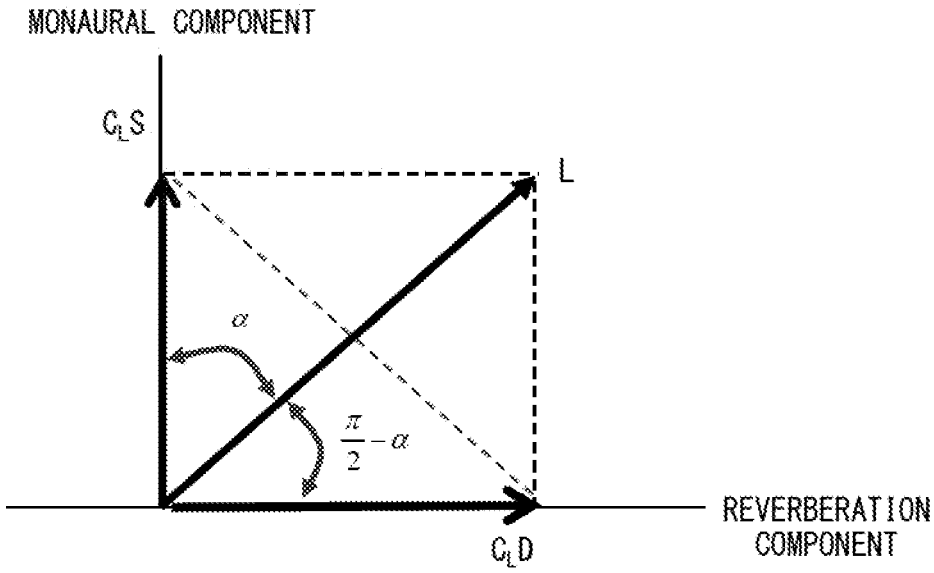
FIG. 18 is an explanatory diagram of a method of generating a stereo signal from s(b,t) and d(b,t)

FIG. 14 is a diagram illustrating an example of a hardware configuration of a computer that can realize a system realized by the first through fourth embodiments.

A computer illustrated in FIG. 14 has a CPU 1401, memory 1402, input device 1403, output device 1404, external storage device 1405, portable recording medium drive device 1406 to which portable recording medium 1409 is inserted and a network connection device 1407, and has a configuration in which these are connected to each other via a bus 1408. The configuration illustrated in FIG. 14 is an example of a computer that can realize the system described above, and such a computer is not limited to this configuration.

The CPU 1401 performs the control of the whole computer. The memory 1402 is a memory such as a RAM that temporally stores a program or data stored in the external storage device 1405 (or in the portable recording medium 1409), at the time of the execution of the program, data update, and so on. The CPU 1401 performs the overall control by executing the program by reading it out to the memory 1402.

The input device 1403 is composed of, for example, a keyboard, mouse and the like and an interface control device for them. The input device 1403 detects the input operation made by a user using a keyboard, mouse and the like, and transmits the detection result to the CPU 1401.

The output device 1404 is composed of a display device, printing device and so on and an interface control device for them. The output device 1404 outputs data transmitted in accordance with the control of the CPU 1401 to the display device and the printing device.

The external storage device 1405 is, for example, a hard disk storage device, which is mainly used for saving various data and programs.

The portable recoding medium drive device 1406 stores the portable recording medium 1409 that is an optical disk, SDRAM, compact flash and so on and has an auxiliary role for the external storage device 1405.

The network connection device 1407 is a device for connecting to a communication line such as a LAN (local area network) or a WAN (wide area network), for example.

The system of the parametric stereo decoding apparatus in accordance with the above first through fourth embodiments is realized by the execution of the program having the functions required for the system by the CPU 1401. The program may be distributed by recording it in the external storage device 1405 or a portable recording medium 1409, or may be obtained by a network by means of the network connection device 1407.

While an embodiment of the present invention is applied to a decoding apparatus in the parametric stereo system in the above first through fourth embodiments, the present invention is not limited to the parametric stereo system, and may be applied to various systems such as the surround system and other ones according which decoding is performed by combining a sound decoding auxiliary information with a decoded sound signal.

What is claimed is:

1. An audio decoding method according which a first decoded sound signal and a first sound decoding auxiliary information are decoded from encoded sound data, and a second decoded sound signal is decoded on the basis of the first decoded sound signal and the first sound decoding auxiliary information, comprising:

calculating a second sound decoding auxiliary information corresponding to the first sound decoding auxiliary information from the second decoding sound signal; and detecting, by comparing the second sound decoding auxiliary information and the first sound decoding auxiliary information, a distortion generated in a decoding process of the second decoded sound signal;

correcting, in the second decoded sound signal, a distortion detected in the detecting of a distortion.

2. The audio decoding method according to claim 1, wherein the first decoded sound signal is a monaural sound decoded signal, the first sound decoding auxiliary information is a first parametric stereo parameter information, the first decoded sound signal and the first sound decoding auxiliary information are decoded from sound data encoded in accordance with a parametric stereo system, the second decoded sound signal is a stereo sound decoded signal, and the second sound decoding auxiliary information is a second parametric stereo parameter information.

3. The audio decoding method according to claim 2, wherein the parametric stereo parameter information is degree of similarity information representing a degree of similarity between stereo sound channels, according to the calculating, second degree of similarity information corresponding to first degree of similarity information being the first parametric stereo parameter information is calculated from the stereo sound decoded signal;

according to the detecting of a distortion, by comparing the second degree of similarity information and the first degree of similarity information for respective frequency bands, a distortion in the respective frequency bands generated in the decoding process of the stereo sound decoded signal is detected; and according to the correcting of a distortion, in the stereo sound decoded signal, the distortion in the respective frequency bands detected in the detecting of a distortion is corrected.

4. The audio decoding method according to claim 3, wherein according to the detecting of a distortion, a distortion amount is detected from a difference between the second degree of similarity information and the first degree of similarity information.

5. The audio decoding method according to claim 4, wherein according to the correction of a distortion, a correction amount of the distortion is determined in accordance with the distortion amount.

6. The audio decoding method according to claim 2, wherein the parametric stereo parameter information is degree of similarity information and intensity difference information that represent a degree of similarity and a intensity difference between stereo sound channels, respectively;

according to the calculating, second degree of similarity information and second intensity difference information corresponding to first degree of similarity information and first intensity difference information that are the first parametric stereo parameter information are calculated from the stereo sound decoded signal;

according to the detecting, by comparing the second degree of similarity information to the first degree of similarity information and the second intensity difference information to the first intensity difference information, respectively for the respective frequency bands, a distortion in the respective frequency bands and in the respective stereo sound channels generated in the decoding process of the stereo sound decoded signal is detected; and according to the correcting of a distortion, the distortion in the respective frequency bands and in the respective stereo sound channels detected by the detecting of a distortion is corrected.

7. The audio decoding method according to claim 6, wherein according to the detecting of a distortion, a distortion amount is detected from a difference between the second degree of similarity information and the first degree of similarity information, and a distortion-generating stereo sound channel is detected from a difference between the second intensity difference information and the first intensity difference information.

8. An audio decoding apparatus decoding a first decoded sound signal and a first sound decoding auxiliary information from encoded sound data, and decoding a second decoded sound signal on the basis of the first decoded sound signal and the first sound decoding auxiliary information, comprising:

a decoded sound analysis unit calculating a second sound decoding auxiliary information corresponding to the first sound decoding auxiliary information from the second decoding sound signal;

a distortion detection unit detecting, by comparing the second sound decoding auxiliary information and the first sound decoding auxiliary information, a distortion generated in a decoding process of the second decoded sound signal; and a distortion correction unit correcting, in the second decoding sound signal, a distortion detected in the distortion detection unit.

9. The audio decoding apparatus according to claim 8, wherein the first decoded sound signal is a monaural sound decoded signal, the first sound decoding auxiliary information is a first parametric stereo parameter information, the first decoded sound signal and the first sound decoding auxiliary information are decoded from sound data encoded in accordance with a parametric stereo system, the second decoded sound signal is a stereo sound decoded signal, and the second sound decoding auxiliary information is a second parametric stereo parameter information.

10. The audio decoding apparatus according to claim 9, wherein the parametric stereo parameter information is degree of similarity information representing a degree of similarity between stereo sound channels, the decoded sound analysis unit calculates second degree of similarity information corresponding to first degree of similarity information being the first parametric stereo parameter information from the stereo sound decoded signal;

the distortion detection unit detects, by comparing the second degree of similarity information and the first degree of similarity information for respective frequency bands, a distortion in the respective frequency bands generated in the decoding process of the stereo sound decoded signal; and the distortion correction unit corrects, in the stereo sound decoded signal, the distortion in the respective frequency bands detected by the distortion detection unit.

11. The audio decoding apparatus according to claim 10, wherein the distortion detection unit detects a distortion amount from a difference between the second degree of similarity information and the first degree of similarity information.

12. The audio decoding apparatus according to claim 11, wherein the distortion correction unit determines a correction amount of the distortion in accordance with the distortion amount.

13. The audio decoding apparatus according to claim 9, wherein the parametric stereo parameter information is degree of similarity information and intensity difference information that represent a degree of similarity and a intensity difference between stereo sound channels, respectively;

the decoded sound analysis unit calculates second degree of similarity information and second intensity difference information corresponding to first degree of similarity information and first intensity difference information that are the first parametric stereo parameter information from the stereo sound decoded signal;

the distortion detection unit detects, by comparing the second degree of similarity information to the first degree of similarity information and the second intensity difference information to the first intensity difference information, respectively for the respective frequency bands, a distortion in the respective frequency bands and in the respective stereo sound channels generated in the decoding process of the stereo sound decoded signal; and the distortion correction unit corrects the distortion in the respective frequency bands and in the respective stereo sound channels detected by the distortion detection unit.

14. The audio decoding apparatus according to claim 12, wherein the distortion detection unit detects a distortion amount from a difference between the second degree of similarity information and the first degree of similarity information, and detects a distortion-generating stereo sound channel from a difference between the second intensity difference information and the first intensity difference information.

15. A non-transitory computer readable medium storing a program for making a computer decoding a first decoded sound signal and a first sound decoding auxiliary information from encoded sound data, and decoding a second decoded sound signal on the basis of the first decoded sound signal and the first sound decoding auxiliary information execute functions comprising:

a decoded sound analysis function calculating a second sound decoding auxiliary information corresponding to first sound decoding auxiliary information from the second decoding sound signal;

a distortion detection function detecting, by comparing the second sound decoding auxiliary information and the first sound decoding auxiliary information, a distortion generated in a decoding process of the second decoded sound signal; and a distortion correction function correcting, in the second decoding sound signal, a distortion detected by the distortion detection function.

16. The non-transitory computer readable medium according to claim 15, wherein the first decoded sound signal is a monaural sound decoded signal, the first sound decoding auxiliary information is a first parametric stereo parameter information, the first decoded sound signal and the first sound decoding auxiliary information are decoded from sound data encoded in accordance with a parametric stereo system, the second decoded sound signal is a stereo sound decoded signal, and the second sound decoding auxiliary information is a second parametric stereo parameter information.

17. The non-transitory computer readable medium according to claim 16, wherein the parametric stereo parameter information is degree of similarity information representing a degree of similarity between stereo sound channels, the decoded sound analysis function calculates second degree of similarity information corresponding to first degree of similarity information being the first parametric stereo parameter information from the stereo sound decoded signal;

the distortion detection function detects, by comparing the second degree of similarity information and the first degree of similarity information for respective frequency bands, a distortion in the respective frequency bands generated in the decoding process of the stereo sound decoded signal; and the distortion correction function corrects, in the stereo sound decoded signal, the distortion in the respective frequency bands detected by the distortion detection function.

18. The non-transitory computer readable medium according to claim 17, wherein the distortion detection function detects a distortion amount from a difference between the second degree of similarity information and the first degree of similarity information.

19. The non-transitory computer readable medium according to claim 18, wherein the distortion correction function determines a correction amount of the distortion in accordance with the distortion amount.

20. The non-transitory computer readable medium according to claim 16, wherein the parametric stereo parameter information is degree of similarity information and intensity difference information that represent a degree of similarity and a intensity difference between stereo sound channels, respectively;

the decoded sound analysis function calculates second degree of similarity information and second intensity difference information corresponding to first degree of similarity information and first intensity difference information that are the first parametric stereo parameter information from the stereo sound decoded signal;

the distortion detection function detects, by comparing the second degree of similarity information to the first degree of similarity information and the second intensity difference information to the first intensity difference information, respectively for the respective frequency bands, a distortion in the respective frequency bands and in the respective stereo sound channels generated in the decoding process of the stereo sound decoded signal; and the distortion correction function corrects the distortion in the respective frequency bands and in the respective stereo sound channels detected by the distortion detection function.

* * * * *